United States Patent [19]

Craig

[11] Patent Number: 4,694,788

[45] Date of Patent: Sep. 22, 1987

[54] INTERNAL COMBUSTION ENGINE ROCKER ARM

[76] Inventor: John A. Craig, P.O. Box 5772, Enid, Okla. 73702

[21] Appl. No.: 845,308

[22] Filed: Mar. 28, 1986

[51] Int. Cl.[4] ..... F01L 1/18

[52] U.S. Cl. ..... 123/90.16; 123/90.39; 123/90.5

[58] Field of Search ..... 123/90.39, 90.27, 90.44, 123/90.5, 90.15, 90.16, 90.17

[56] References Cited

U.S. PATENT DOCUMENTS

| | | | |
|---|---|---|---|
| 1,395,851 | 11/1921 | McLean | 123/90.39 |
| 1,440,427 | 1/1923 | Wigelius et al. | 123/90.16 |
| 1,483,267 | 2/1924 | Asplund | 123/90.16 |
| 1,520,208 | 12/1924 | Pielstick | 123/90.16 |
| 2,054,928 | 9/1936 | Church | 123/90.27 |
| 3,466,073 | 9/1969 | Pohle | 123/90.39 |
| 4,519,345 | 5/1985 | Walter | 123/90.16 |
| 4,549,509 | 10/1985 | Burtchell | 123/90.16 |

*Primary Examiner*—Ira S. Lazarus

*Attorney, Agent, or Firm*—Robert K. Rhea

[57] ABSTRACT

In an internal combustion engine having a rocker arm provided at one end with a roller contacting an exhaust valve stem for opening the valve, the rocker arm end portion is transversely slotted longitudinally normal to the axis of the valve stem to provide a longitudinally adjustable exhaust valve operating rocker arm. The transverse slot communicates with the transverse bore supporting the roller journalling bolt thus permitting adjusting movement of the roller longitudinally of the rocker arm and relative to the axis of the exhaust valve stem for the optimum friction reducing position of the roller relative to the valve stem.

3 Claims, 4 Drawing Figures

INTERNAL COMBUSTION ENGINE ROCKER ARM

BACKGROUND OF THE INVENTION

1. Field of the invention

The present invention relates to engines and more particularly to a rocker arm for relatively large oil well pumping engines.

In producing oil fields pumping units are employed for operating down hole pumps to lift the oil to the surface of the earth. In some of these oil fields, commonly known as shallow fields, a single engine, such as a No. 346 or No. 503 Fairbanks, Morse and Co. engine, is centrally located with respect to a number of the wells and horizontally rotates a control wheel of relatively large diameter for reciprocating a plurality of eccentrically connected lift strings separately connected with like a plurality of pumping jacks at respective well locations. These lift strings are usually formed from sucker-like rod material and one such engine is capable of pumping several oil wells. This engine generally has its single cylinder horizontallly disposed and its cylinder head is equipped with spring urged intake and exhaust valves, the intake valve being opened by reduced pressure in the engine cylinder and the exhaust valve being opened by a cam operated push rod moving a rocker arm in sequence with the engine timing.

2. Description of the prior art

Respective end portions of the exhaust valve rocker arm in the above described engines have usually been hardened or at least case hardened to prolong their life and reduce the wear thereto caused by continuous contact with the exhaust valve stem and the push rod. The resulting wear necessitates replacement of the rocker arm as well as some arrangement for adjusting the magnitude of rocking movement of the rocker arm and insuring full opening and closing of the valve. This has been accomplished to some extent by providing a screw at the push rod end of the rocker arm which may be threadedly moved axially toward and away from the push rod and held in place by a lock nut.

A friction reducing roller has also been installed on the opposite end of the rocker arm for contact with the valve stem. While this arrangement has been generally satisfactory it does not provide accurate aligned contact of the roller with the valve stem axis resulting in a lateral force on the valve stem tending to wear the valve guide and resultant necessary repairs to the engine and a loss of oil production during such down time.

This invention provides a means for obtaining accurate alignment of the rocker arm roller with the exhaust valve stem.

SUMMARY OF THE INVENTION

A substantially conventional internal combustion engine rocker arm having a transverse bore for axially mounting the rocker arm on a rocker arm shaft or support on the head of an engine cylinder is provided with a lock nut equipped adjusting screw at its push rod contacted end portion. The adjusting screw axially contacts the engine rocker arm push rod. The other end of the rocker arm is slotted and journals a roller on an axis normal to the axis of the valve stem and is intended to cooperatingly contact the adjacent end of the valve stem. This invention comprises forming a longitudinal elongated slot extending transversely through the roller equipped end portion of the rocker arm normal to the roller nesting rocker arm slot which intersects the bore journalling the roller. This permits the roller to be moved longitudinally of the rocker arm toward and away from the rocker arm shaft to adjust the distance between the axis of the roller and the axis of the rocker arm shaft to equal the spacing between the axis of the exhaust valve stem and the axis of the rocker arm shaft so that the rocker arm movement axially moves the exhaust valve.

The principal object of this invention is to provide a rocker arm featuring an adjustable roller at one of its ends for insuring accurate valve stem contact of the roller and axial movement of the valve stem and which permits adjusting the roller position in accordance with the dimension between the rocker arm shaft axis and the axis of the exhaust valve on different makes of engines for minimizing valve stem wear and increasing engine life.

DESCRIPTION OF THE PREFERRED EMBODIMENTS

Figure 2:
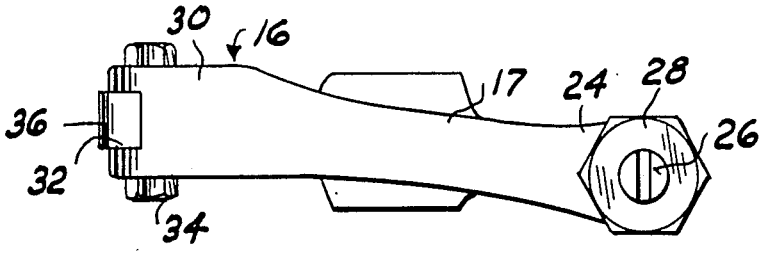
FIG. 2 is a top view of the rocker arm, per se.

Like characters of reference designate like parts in those figures of the drawings in which they occur.

Figure 1:
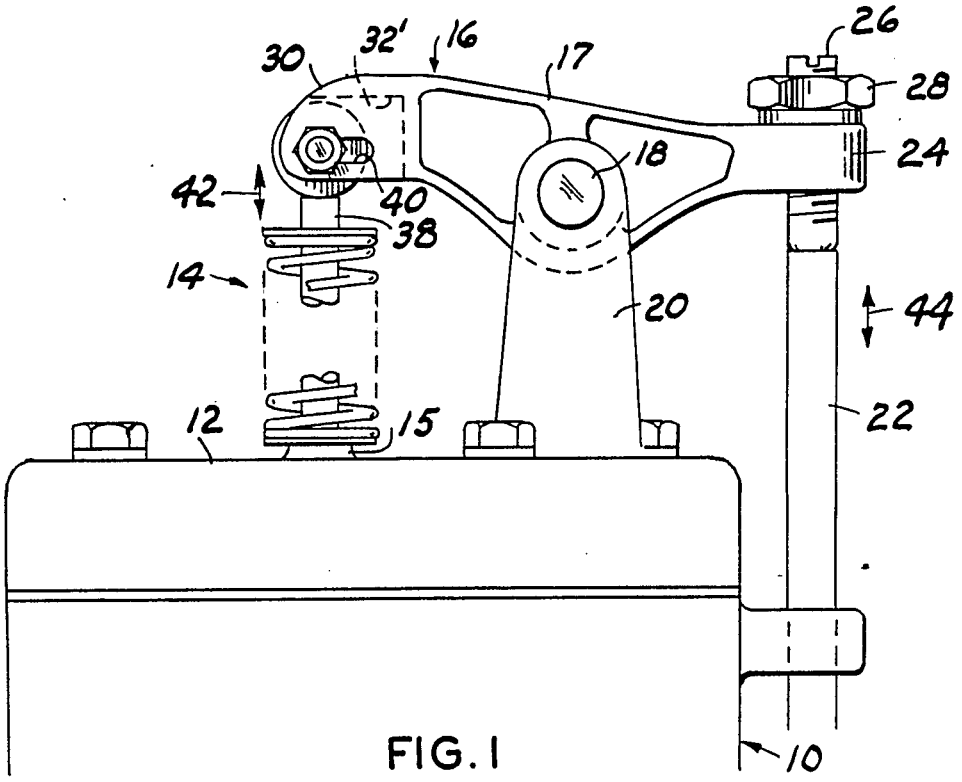
FIG. 1 is a fragmentary elevational view of the improved rocker arm installed on an engine.

In the drawings:

Referring first to FIGS. 1 and 2 the reference numeral 10 indicates an engine cylinder having a head 12 which includes a spring closed exhaust valve 14 reciprocating in a valve stem guide 15. The exhaust valve is opened and closed by a rocker arm 16 having a central hub equipped body portion 17 pivotally mounted on a rocker arm shaft 18 supported by a bracket 20 and moved by the engine cam operated push rod 22. The push rod end portion 24 of the rocker arm threadedly receives an adjusting screw 26 substantially axially aligned with the push rod 22 with the screw being held in place by a lock nut 28. The other end portion 30 of the rocker arm is longitudinally slotted normal to the axis of its rocker arm shaft receiving bore, as at 32, and transversely bored normal to the slot 32 for receiving a bolt and nut 34 and journalling a roller 36 for contact with the stem 38 of the exhaust valve. The above description is conventional with presently used rocker arms on engines of the type described.

The rocker arm 16 is modified by extending the roller nesting slot 32 toward the rocker arm shaft, as at 32', and transversely slotting the rocker arm end portion 30 to form an elongated slot 40 extending longitudinally of the rocker arm and communicating with the bore receiving the bolt 34 with the width of the slot being equal to the diameter of the bolt receiving bore. This permits the roller 36 and its journalling bolt 34 to be moved toward and away from the axis of the rocker arm shaft 18 to compensate for variances in the distance between the axis of the valve stem 38 and the axis of the rocker arm shaft 18 when the rocker arm is used on engines manufactured by different manufacturers. This adjustment insures that the axis of the bolt and roller 36 intersects the axis of the valve stem 38 when the valve is in closed position so that when reciprocating motions of the respective portions of the rocker arm, as indicated by the arrows 42 and 44, minimizes any lateral force applied to the valve stem 38 which would wear the valve stem guide 15.

Figure 3:
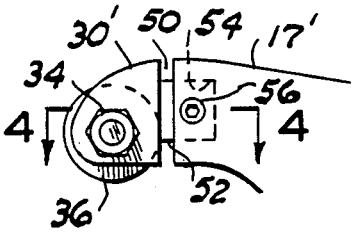
FIG. 3 is a fragmentary side elevational view of the alternative embodiment; and, FIG. 4 is a horizontal sectional view taken substantially along the line 4—4 of FIG. 3.
Figure 4:
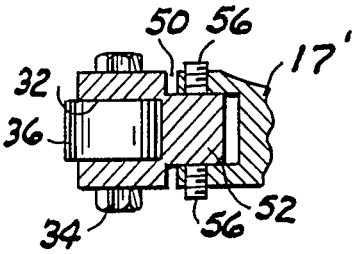

Referring also to FIGS. 3 and 4, a modified form of the rocker arm is shown in which its end portion 30 is transversely divided, as at 50, to form a separate end portion 30' separable from the rocker arm body 17'. The rocker arm end portion 30' includes the roller 36 journalled by the bolt and nut 34 with the slot roller slot extension 32' and the slot 40 being omitted. The end portion 30' is characterized by a rectangular, preferably square in transverse section, central lug 52 on its end surface facing the rocker arm body portion 17' which is cooperatively received by a socket 54 formed therein. A pair of set screws, such as Allen screw 56, threadedly enter opposing bores formed in the body portion 17' for frictionally gripping the lug 52. Thus the rocker arm end portion 30' may be moved toward and away from the rocker arm shaft by loosening and then retightening the screws 56 which maintains the roller in the previously described desirable position relative to the axis of the exhaust valve stem 38.

Obviously the invention is susceptible to changes or alterations without defeating its practicability. Therefore, I do not wish to be confined to the preferred embodiment shown in the drawings and described herein.

I claim:

1. In an internal combustion engine cylinder head exhaust valve operating elongated rocker arm having a friction reducing valve stem end contacting roller journalled by a bolt extending through a transverse bore in one end portion of the rocker arm normal to the axis of the valve stem, the improvement comprising:

means for adjusting the position of the roller longitudinally of the rocker arm and relative to the axis of the exhaust valve stem.

2. The combination according to claim 1 in which the means comprises:

a transverse slot extending longitudinally of the rocker arm in its said one end portion in communication with the roller journalling bolt containing bore.

3. The combination according to claim 1 in which the rocker arm is transversely divided adjacent the roller and a polygonal wall socket is formed in its end portion facing the roller and in which the means comprises:

a lug formed on the end portion of the rocker arm facing the socket and having a length greater than the depth of the socket for cooperatively entering the socket; and, set screw means supported by the rocker arm for securing said lug within the socket.

* * * * *